US009102441B1

(12) United States Patent
Orvik

(10) Patent No.: US 9,102,441 B1
(45) Date of Patent: Aug. 11, 2015

(54) COMPARTMENTALIZED DISPENSING LID FOR BEVERAGE CONTAINER

(71) Applicant: Bradley Orvik, Apollo Beach, FL (US)

(72) Inventor: Bradley Orvik, Apollo Beach, FL (US)

( * ) Notice: Subject to any disclaimer, the term of this patent is extended or adjusted under 35 U.S.C. 154(b) by 0 days.

(21) Appl. No.: 14/081,239

(22) Filed: Nov. 15, 2013

Related U.S. Application Data

(60) Provisional application No. 61/880,388, filed on Sep. 20, 2013.

(51) Int. Cl.

| | |
|---|---|
| ***B65D 25/08*** | (2006.01) |
| ***B65D 25/52*** | (2006.01) |
| ***B65D 43/06*** | (2006.01) |
| ***B65D 51/28*** | (2006.01) |

(52) U.S. Cl.
CPC ..... *B65D 25/08* (2013.01); *B65D 25/525* (2013.01); *B65D 43/06* (2013.01); *B65D 51/2807* (2013.01)

(58) Field of Classification Search
CPC ..... B65D 25/04; B65D 1/04; B65D 83/0454; B65D 83/0445; B65D 83/04; B65D 2583/0445; B65D 2583/0436; B65D 2583/04; B65D 2585/56; B65D 47/263; B65D 47/261; B65D 47/26; B65D 47/20; A47G 19/2205
USPC ..... 220/253, 523, 524, 23.86, 23.83, 703, 220/694, 62.22, 62.18, 592.2, 592.17, 220/592.16; 206/217, 223, 535, 539, 538; 222/136, 135, 144, 144.5
See application file for complete search history.

(56) References Cited

U.S. PATENT DOCUMENTS

| | | | | |
|---|---|---|---|---|
| 1,672,904 | A * | 6/1928 | Randall | 220/592.27 |
| 2,376,064 | A * | 5/1945 | Knapp | 215/13.1 |
| 3,120,319 | A * | 2/1964 | Buddrus | 215/12.2 |
| 4,993,584 | A * | 2/1991 | Macario | 220/523 |
| 5,329,778 | A * | 7/1994 | Padamsee | 62/56 |
| D390,964 | S | 2/1998 | Mercer et al. | |
| 6,681,958 | B2 | 1/2004 | Sorenson et al. | |
| 8,141,700 | B2 | 3/2012 | Simonian et al. | |
| 8,365,960 | B1 | 2/2013 | Kalaouze | |
| 2010/0142330 | A1 | 6/2010 | Reygaert | |
| 2010/0183776 | A1 | 7/2010 | Gruenwald et al. | |
| 2012/0223100 | A1 | 9/2012 | Simonian et al. | |
| 2012/0261283 | A1 | 10/2012 | Anson et al. | |
| 2012/0305514 | A1 | 12/2012 | Harris | |
| 2013/0037506 | A1 | 2/2013 | Wahlstrom | |

* cited by examiner

*Primary Examiner* — Robert J Hicks
(74) *Attorney, Agent, or Firm* — Robert C. Montgomery; Montgomery Patent and Design, LP.

(57) ABSTRACT

A compartmentalized dispensing lid and a beverage container having a lid with a platform and a domed structure equipped with decanter mechanism and a plurality of compartments. The lid is fastenable to a beverage container, where the decanter mechanism enables a user to drink liquids housed within the beverage container. The plurality of compartments are each partitioned to hold and separate various dietary supplements from each other and from the liquid held within the beverage container. The dome and platform arrangement enables selectively dispersing a supplement of a certain compartment into the liquid of the beverage container to create a mixture that is consumed through the decanter mechanism.

19 Claims, 3 Drawing Sheets

COMPARTMENTALIZED DISPENSING LID FOR BEVERAGE CONTAINER

RELATED APPLICATIONS

The present invention was first described in and claims the benefit of U.S. Provisional Application No. 61/880,388, filed Sep. 20, 2013, the entire disclosures of which are incorporated herein by reference.

FIELD OF THE INVENTION

The present invention relates to a compartmentalized dispensing lid for a beverage container to contain and selectively dispense ingredients placed within the lid.

BACKGROUND OF THE INVENTION

Many people consume dietary supplements as part of their regular exercise workout. These supplements are typically provided in powder or pill format, and are intended to be mixed with a liquid, such as water, immediately before consumption. Some of these supplements are specifically formulated to be taken before exercise, during exercise, and after exercise. This requires users to carry multiple containers, plastic bags, or the like along with liquid containers to mix such products at the proper time. Such mixing, shaking, and consumption regiments take time away from the exercise routine, and may even lead to consumption errors and a loss of the supplement benefits. Accordingly, there exists a need for a means by which powder and pill supplements can be easily stored, mixed, and consumed without the disadvantages as described above. The development of the present invention fulfills this need.

The apparatus is a system for adding powdered or pill-style additives to a liquid immediately before ingestion. The lid of a beverage container is provided with a plurality of separate compartments. Each compartment is accessed from the top to place supplement powder or a pill, which are designed to be ingested as a solution when mixed with a liquid. At the desired time, the lid is rotated by the user to drop the supplement into the liquid below, without removing the lid. The beverage container can then be shaken, creating the mixture solution, and the resultant mixture is consumed from the beverage container from a drink aperture of the lid. The liquid is then refilled as needed. This process is repeated as necessary for various phases of the exercise routine such as before, during, and after.

Prior art in this field consists of lids for beverage containers that have a compartment with a means to dispense the contents of the compartment into the beverage container via a lever-activated draw door, or otherwise require removal of the lid and manual manipulation to pour the contents of the compartment into the beverage container. Nothing within the prior art enables selective disposition of contents within a compartment of a plurality of compartments by mere rotation of the lid.

Other prior art related devices have lids with a storage compartment leading to a nozzle that selectively permits infiltration of the compartment by liquid of the beverage container to create the mixture while drinking from the nozzle. Additional prior art related devices incorporate a rotating apertured-platform assembly within the beverage container that creates isolated segments of the beverage container when apertures are not aligned, but permits fluid communication between the segments when aligned. Neither the prior art nor a combination of prior art related devices achieve the utility that the current invention achieves.

It is an object of the current invention to enable storage of a plurality of different ingredients within separate compartments of a lid portion of a beverage container, and prevent mixing of any ingredient with any liquid contained within the beverage container, unless a user operates the device to do so.

It is a further object of this invention to enable storage and transport of a plurality of different ingredients within separate compartment of a lid portion of a beverage container without disruption, contamination, or mixing of any of the ingredients contained within each compartment of the lid.

It is a further object of this invention to enable drinking from the lid portion without disruption, contamination, or mixing of any of the ingredients contained within each compartment of the lid.

It is a further object of this invention to enable drinking from the lid portion without mixing of the liquid being consumed from the beverage container with any of the ingredients contained within each compartment, unless a user operates the device to do so.

It is a further object of this invention to selectively dispense an ingredient from any one compartment into an interior space of a beverage container and create a mixture of the ingredient with liquid held in the beverage container by agitation of the mixture without further disruption, contamination, or mixing of any of the remaining ingredients contained within each compartment of the lid.

It is a further object of this invention to enable selective deposition of an ingredient from any one compartment by mere rotation of the lid in a preferred direction.

It is a further object of this invention to enable filling the beverage container and each compartment, as well as discharging the beverage container and each compartment, without the need to remove the lid; however, the lid is removable.

An added benefit of this invention is to provide a specific configuration of the lid so that translucent material of the lid may be exploited to enable a user to quickly ascertain which supplement has been consumed without the need to open the various compartments.

An additional benefit of this invention is to provide a double-shelled beverage container for added insulation.

SUMMARY OF THE INVENTION

The apparatus comprises a lid having a plurality of compartments to be used with a beverage container. The compartments provide a means to store and transport ingredients that will be selectively dispensed within the interior of the container at a user's discretion. The lid has a dome pivotally affixed to a platform. Extending from the platform is an apron, which enables removably coupling the lid to a beverage container. The dome is provided with the plurality of compartments, and it rotates with respect to the platform. One (1) compartment is reserved for drinking liquid contents from the beverage container, whereas the other compartments are used to contain ingredients that will be dispensed into the liquid contents of the beverage container. A fill tube with a covering cap is disposed on each fill tube, except for the one reserved for drinking, which facilitates deposition of ingredients into each compartment. A separate cap is further provided for the compartment reserved for drinking liquids from the beverage container.

The platform is a solid planer member with a single aperture, which grants the only access into an interior of the beverage container when the platform is attached to the beverage container. An upper surface of the platform forms the lower containment surface for each compartment of the dome. As ingredients are deposed into the compartments, they are contained by the volume defined by an interior of each compartment and the upper surface of the platform. As the dome is rotated, each compartment rotates and any deposed ingredients are carried along with the compartment containing it. As a compartment is position over the single aperture of the platform, the ingredients are allowed to fall into the interior of the beverage container. The dome is then rotated in an opposite direction to position the drinking compartment over the single aperture. In this position, a user may drink the mixture comprising the liquid and ingredient through the drinking compartment.

The apron comprises an annular ring extending from a perimeter edge of the platform. An inside surface of the apron is provided with a fastening mechanism to facilitate removable coupling of the lid to a beverage container. The apron is further provided with a seal to enable proper and adequate containment of fluids within the beverage container by the lid.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
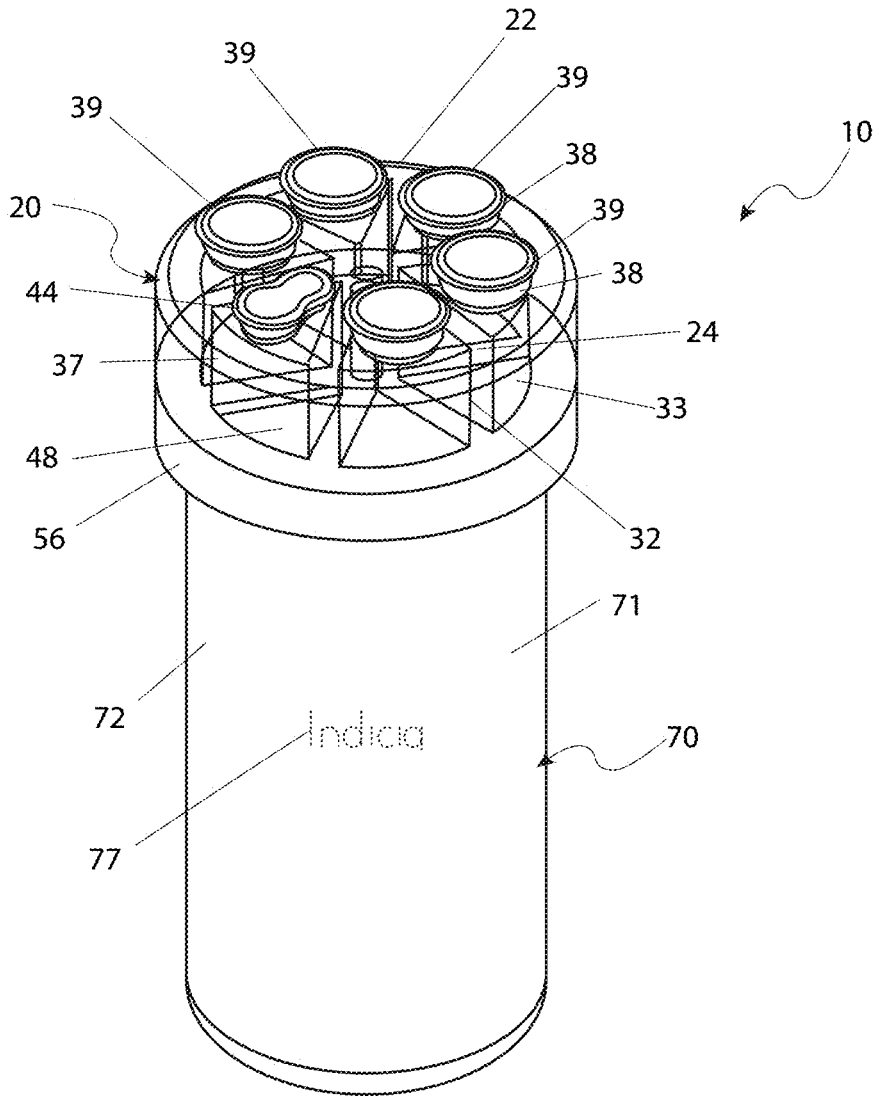
FIG. 1 is an isometric view of a compartmentalized dispensing lid for a beverage container 10 in accordance with the preferred embodiment of the present invention.

10 compartmentalized dispensing lid for a beverage container
20 lid
22 dome
24 separator
26 seal ring groove
28 seal ring
32 first compartment
33 second compartment
34 third compartment
35 fourth compartment
36 fifth compartment
37 drinking compartment
38 fill tube
39 cap
42 mouth aperture
44 cover
46 platform
48 platform aperture
50 pivot pin
54 lid seal
56 apron
58 internal thread
70 container
71 shell
72 sidewall
73 opening
74 bottom
75 interior
76 external thread
77 indicia

DETAILED DESCRIPTION OF THE PREFERRED EMBODIMENT

Figure 2:
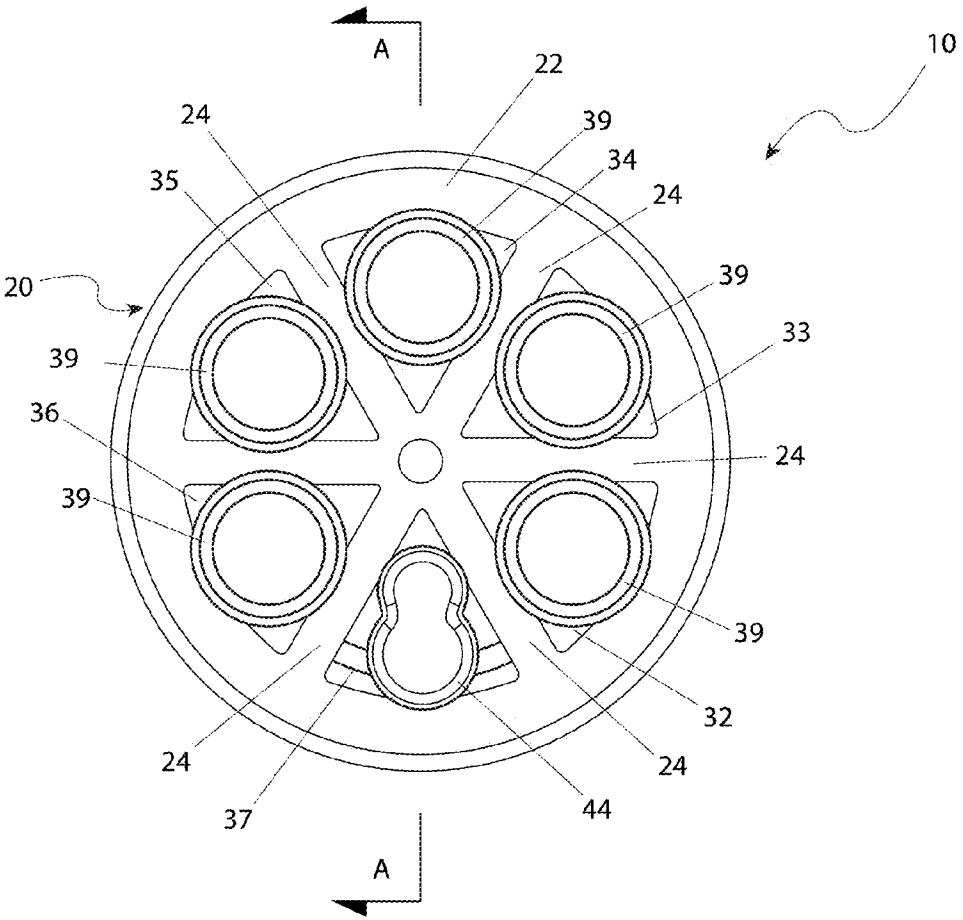
FIG. 2 is a plan view of the compartmentalized dispensing lid for a beverage container 10 in accordance with the preferred embodiment of the present invention; and, FIG. 3 is a section view along a line A-A as shown on FIG. 2 of the compartmentalized dispensing lid for a beverage container 10 in accordance with the preferred embodiment of the present invention.
Figure 3:
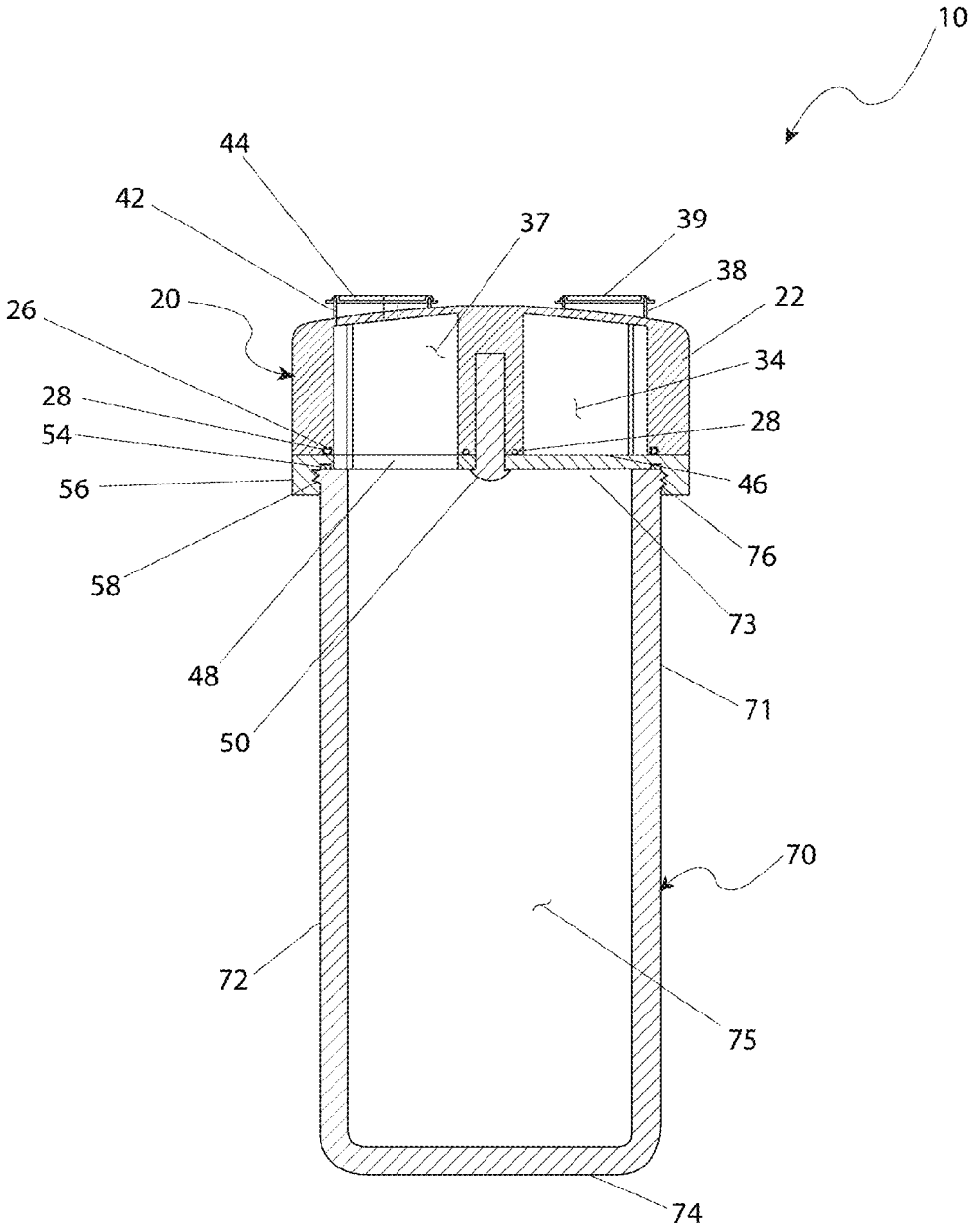

In accordance with the invention, the best mode is presented in terms of a preferred embodiment, herein depicted within FIGS. 1 through 3. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes a compartmentalized dispensing lid for a beverage container (herein referred to as the "apparatus") 10, which provides a means to transport a plurality of ingredients, in a powder or pill form, within the separated compartments 32-37 of the compartmentalized lid 20 of a container 70 and disperse those ingredients individually into said container 70, and the liquid therein, for consumption as a solution.

Referring now to FIG. 1, an isometric view of the apparatus 10 according to the preferred embodiment of the present invention, is disclosed. The apparatus 10 comprises a compartmentalized lid 20 and a beverage container 70. The lid 20 comprises a dome 22 attached to a platform 46 (see FIG. 3) structure having an apron 56 by means of a pivot pin 50 (see FIG. 3) such that the dome 22, with the pivot pin 50 (see FIG. 3), is capable of rotating with respect to the platform 46 (see FIG. 3). The dome 22 preferably comprises a translucent thermoplastic material and formed in an injection molding process with a generally cylindrical shape and having a plurality of compartments 32-37 (see also FIG. 2) divided by separators 24. The compartments 32-37 (see also FIG. 2) have a circular sector cross-section with one (1) of the compartments 32-37 (see also FIG. 2) being designated as the drinking compartment 37; through which the contained liquid must pass in order to be consumed. The dome 22 is flat on the lower face and the compartments 32-37 (see also FIG. 2) are open at the bottom end. Disposed in the bottom of the separators 24 and the peripheral wall are seal ring grooves 26, which are formed, or cut, around the periphery of each compartment 32-37 as seen in FIG. 3. A seal ring 28 (see FIG. 3) preferably comprises a rubber, or nitrile, material, having the general shape of the circular sector seal ring grooves 26 (see FIG. 3) would be placed in each seal ring groove 26 (see FIG. 3) to make a liquid-tight seal around each compartment 32-37 (see also FIG. 2) between the dome 22 and the platform 46 (see FIG. 3).

Disposed in the center of the bottom of the dome 22 is a circular channel into which the pivot pin 50 (see FIG. 3) is pressed, or otherwise secured. The dome 22 is preferably convex on the upper face and disposed on that upper face are a plurality of tubular fill tubes 38, which junction with the ordinal (first, second, third, etc.) compartments 32-36 (see also FIG. 2) for the deposition of various ingredients. A mouth aperture 42 (see FIG. 3) is disposed above, and junctions with the drinking compartment 37. The mouth aperture 42 (see FIG. 3) would preferably have a shape such as a figure eight (8) or an oval to be different from the round fill tubes 38 so that said mouth aperture 42 (see FIG. 3) would be more easily discernable. A plurality of caps 39, preferably comprising disks of a thermoplastic material with raised annular sealing grooves, would be used to close and seal each fill tube 38. A cover 44, preferably comprises a thermoplastic material having the general shape of the cross-section of the mouth aperture 42 (see FIG. 3) with a raised peripheral sealing groove, would be used to close and seal said mouth aperture 42 (see FIG. 3). In certain embodiments, the caps 39, or the cover 44, or both, may be provided with hinges to attach said caps 39 and/or cover 44 to either the dome 22 or to the fill tubes 38 and/or mouth aperture 42 (see FIG. 3) without limiting the scope of the apparatus 10. The upper surface of the dome 22 may alternately be planar, or otherwise shaped, without limiting the scope of the apparatus 10.

The platform 46 (see FIG. 3) with the conjoined apron 56 preferably comprises a thermoplastic material formed in an injection molding process with a planar top surface. The top surface of the platform 46 (see FIG. 3) must be flat and smooth so as seal against the dome 22 with the provided seal rings 28 (see FIG. 3). The internal features of the platform 46 (see FIG. 3) and apron 56 are more clearly illustrated in FIG. 3. Disposed in the platform 46 (see FIG. 3) is a platform aperture 48 having a circular sector shape and normally being in alignment with the drinking compartment 37 of the dome 22. Also disposed in the center of the platform 46 (see FIG. 3) is an aperture (not shown) for insertion of the pivot pin 50 (see FIG. 3), which is intended to secure said platform 46 (see FIG. 3) to the dome 22. It may be advantageous to place a spring washer around the shank of the pivot pin 50 (see FIG. 3) and between the head of said pivot pin 50 (see FIG. 3) and the lower face of the platform 46 (see FIG. 3) in order to enhance the relative motion, and improve the mutual seal, between the dome 22 and said platform 46 (see FIG. 3); however, it is understood that any such eventualities do not modify the scope or intent of the present apparatus 10 and this preferred embodiment does not preclude any other embodiment. The apron 56 comprises an annular ring formed subjacent to the planar platform 46 (see FIG. 3) and is provided with a formed, or cut, internal thread 58 (see FIG. 3), or plurality of thread segments, to secure the lid 20 to the container 70. At the internal junction of the apron 56 and the platform 46 (see FIG. 3) is a lid seal 54 (see FIG. 3) that comprises a rubber, or nitrile material, for the purpose of forming a liquid-tight seal between the lid 20 and the container 70. The lid seal 54 (see FIG. 3) may be retained within the lid 20 by means of an interference fit in a groove formed into said lid 20, or it may comprise an individual piece without limiting the scope of the apparatus 10.

The shell 71 portion of the container 70 of the device 10 preferably comprises a molded thermoplastic material and as such may be presented in a wide variety of colors and surface finish textures. However, it is understood that other materials such as stainless steel, or drawn aluminum, may be utilized without limiting the scope of the apparatus 10. Additionally, it is envisioned that some surface portions of the container 70 may comprise various indicia 77, which may provide script or logos based upon a user's preference and may include images such as, but not limited to, business names/logos, personal names, symbols, lines, pictures, and the like, in various colors and patterns, to further customize and personalize the apparatus 10.

Referring now to FIG. 2, a plan view of the apparatus 10, according to the preferred embodiment of the present invention, is disclosed. The purpose of FIG. 2 is to illustrate the positioning of the ordinal compartments 32-36 and the drinking compartment 37 within the dome 22. In the typical arrangement of the lid 20 attached to the container 70 (see FIG. 1), the first compartment 32 is positioned to the right of the drinking compartment 37 in a counter-clockwise direction. Thus, a clockwise rotation of the dome 22 relative to the platform 46 (see FIG. 3) will bring the lower end of the first compartment 32 into alignment with the platform aperture 48 (see FIG. 3) and allow any substance contained within said first compartment 32 to fall into the container 70 (see FIG. 1). After the ingredient contained within the first compartment 32 has entered the container 70 (see FIG. 1), the dome 22 can be rotated in a counter-clockwise direction to bring the drinking compartment 37 back into alignment with the platform aperture 48 (see FIG. 3) so that the solution in said container 70 (see FIG. 1) may enter said drinking compartment 37 if the apparatus 10 is tipped. The second compartment 33 is positioned within the dome 22 next to the first compartment 32 in a counter-clockwise direction, and likewise the third compartment 34 is positioned next to said second compartment 33 in a counter-clockwise direction and so on. The seal rings 28 (see FIG. 3) disposed within the seal ring grooves 26 (see FIG. 3) located at the lower end of each compartment 32-37, as seen in FIG. 3, will prohibit the entrance of any solution into any said compartment 32-37, which is not in alignment with the platform aperture 48 (see FIG. 3). It may be advantageous to place indexing detents into the dome 22 or into the platform 46 (see FIG. 3), or both, so that a positive positioning indication may be established for said dome 22 and any particular compartment 32-37 alignment, however, it is understood that any such eventualities do not modify the scope or intent of the present apparatus 10 and this preferred embodiment does not preclude any other embodiment.

Referring now to FIG. 3, a section view along line A-A as seen in FIG. 2 of the apparatus 10, according to the preferred embodiment of the present invention, is disclosed. The shell 71 of the container 70 comprises an encircling sidewall 72, which terminates at a lower side in a conjoined bottom 74 to form an interior 75 capable of holding a volume of liquid. The upper end of the sidewall 72 has an opening 73 for the entrance and exit of liquids or other ingredients. Preferably disposed upon the exterior of the upper end of the sidewall 72 is an external thread 76, or a plurality thread segments, for the purpose of retaining the lid 20 engaged in said external thread 76. In some embodiments the sidewall 72 may be comprised of a double shell with an insulated interior layer without limiting the scope of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized in a simple and straightforward manner with little or no training. After initial purchase or acquisition of the apparatus 10, it would be configured as indicated in FIG. 1.

The method of utilizing the apparatus 10 may be achieved by performing the following steps: acquiring a model of the apparatus 10 having a desired style to suit the taste of a user; placing the dome 22 as shown in FIG. 2 such that the drinking compartment 37 is in alignment with the platform aperture 48; removing the cap 39 from the fill tube 38 of the first compartment 32; placing a measure of the ingredient deemed to be consumed initially into the first compartment 32; reinstalling the cap 39 onto the fill tube 38 so as to seal the first compartment 32; removing the cap 39 from the fill tube 38 of the second compartment 33; placing a measure of the ingredient deemed to be consumed as a second iterative step of the regimen into the second compartment 33; reinstalling the cap 39 onto the fill tube 38 so as to seal the second compartment 33; repeating the cap 39 removal, compartment 34-37 filling, and cap 39 replacement portion of the procedure for each successive measure of ingredient of the user's regimen until all, or the desired number, of the compartments 32-37 have been filled and sealed; placing the correct quantity of beverage into the container 70; securing the lid 20 to the container 70; transporting the apparatus 10 to the desired destination; at the appointed time, turning the dome 22 of the lid 20 clockwise relative to the platform 46 and apron 56 until the first compartment 32 is in alignment with the platform aperture 48 and the first ingredient falls into the beverage; turning the dome 22 counter-clockwise until the covered mouth aperture 42 is aligned with the platform aperture 28; shaking the apparatus 10 to mix the first ingredient into the beverage; removing the cover 44 from the mouth aperture 42; drinking the solution; replacing the cover 44 onto the mouth aperture 42; refilling the container 70 with the desired second beverage; at the appointed time, turning the dome 22 clockwise relative to the platform 46 and apron 56 until the second compartment 33 is in alignment with the platform aperture 48 and the second ingredient falls into the beverage; turning the dome 22 counter-clockwise until the covered mouth aperture 42 is aligned with the platform aperture 48; shaking the apparatus 10 to mix the second ingredient into the beverage; removing the cover 44 from the mouth aperture 42; drinking the solution; replacing the cover 44 onto the mouth aperture 42; and repeating the filling, combining, mixing, and drinking portions of the procedure until all of the subsequent measures of ingredients have been consumed at the proper time.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A compartmentalized holding and dispensing apparatus, comprising:

a translucent, cylindrical dome, comprising:

a dome base having a planar bottom surface and a convex top surface;

a drink compartment disposed on said top surface, having an open bottom;

a plurality of storage compartments disposed on said top surface, each having an open bottom; and, wherein each storage compartments and said drink compartment are arranged to adjoin each other but are separated by a partition;

a channel disposed at a central location of said bottom surface of said dome;

a plurality of fill tubes, each having a tubular shape, extending from a top of each storage compartment;

a mouth aperture extending from a top of said drink compartment;

a plastic, circular platform, comprising:

a disk member having a flat top surface;

a platform aperture located at a position to align with either one of said storage compartments or said drink compartment when said dome is placed over top of said platform; and, a pivot aperture located at a position to align and engage said channel when said dome is placed over top of said platform;

a pivot pin, wherein:

said pivot pin slidably inserts between said engagement of said channel and said pivot aperture when said dome is placed over top of said platform; and, arrangement of said pivot pin, said pivot aperture, and said channel enables rotation of said dome relative to said platform while securing said dome to said platform;

an apron, comprising an annular member extending perpendicularly from said platform;

wherein said dome, when engaged with said platform, is placed on top of an ancillary container such that said apron extends over perimeter edges of said ancillary container;

wherein rotation of said dome relative to said platform enables selective alignment of said platform aperture with one of said storage compartments, thereby facilitating fluid communication between an interior space of said storage compartment and an interior space of said ancillary container; and, wherein rotation of said dome relative to said platform enables selective alignment of said platform aperture with said drink compartment, thereby facilitating fluid communication between an interior space of said drink compartment and an interior space of said ancillary container.

2. The apparatus recited in claim 1, wherein said drink compartment has a circular sector cross section configuration.

3. The apparatus recited in claim 1, wherein each storage compartment has a circular sector cross section configuration.

4. The apparatus recited in claim 1, wherein each partition is provided with a groove about a perimeter edge thereof.

5. The apparatus recited in claim 4, further comprising a rubber seal ring fitted into each of said groove.

6. The apparatus recited in claim 1, further comprising at least one storage cap to cover and protect a fill tube.

7. The apparatus recited in claim 6, wherein each storage cap is provided with raised annular seal grooves to enable securement of said storage cap to a top of said fill tube via an interference fit.

8. The apparatus recited in claim 6, further comprising a fastening mechanism to hingedly affix each storage cap to a top of each fill tube.

9. The apparatus recited in claim 1, further comprising a plastic drink cap to cover and protect said mouth aperture.

10. The apparatus recited in claim 9, wherein said drink cap is provided with raised annular seal grooves to enable securement of said drink cap to a top of said mouth aperture via an interference fit.

11. The apparatus recited in claim 9, further comprising a fastening mechanism to hingedly affix said drink cap to a top of said mouth aperture.

12. The apparatus recited in claim 1, further comprising:

a spring washer disposed about said pivot pin and situated between said dome and said platform; and, wherein said spring washer places tension on said dome and said platform to provide better securement of said dome with said platform and facilitate better rotational motion of said dome relative to said platform.

13. The apparatus recited in claim 1, further comprising a fastening mechanism to removably secure said apron to a mouth portion of said ancillary container.

14. The apparatus recited in claim 1, further comprising a seal placed within said apron to form a fluid tight abutment between said apron and said ancillary container.

15. The apparatus recited in claim 14, wherein an inside surface of said apron is provided with a groove that is configured to receive and retain said seal via an interference fit.

16. The apparatus recited in claim 1, wherein said dome is provided with at least one detent to engage a portion of said platform as said dome is rotated to hold said dome in a desired position.

17. The apparatus recited in claim 1, wherein said platform is provided with at least one detent to engage a portion of said dome as said dome is rotated to hold said dome in a desired position.

18. The apparatus recited in claim 1, wherein said platform and said dome are each provided with at least one detent to engage a portion of said dome as said dome is rotated to hold said dome in a desired position.

19. A compartmentalized holding and dispensing apparatus, comprising:

a container, further comprising:

a double-walled encircling sidewall structure, having a double-walled base conjoined with a bottom of said sidewall structure;

an open mouth at a top of said sidewall structure;

an insulating material placed between said double-walled sidewall and said double-walled base;

a coupling mechanism to removably secure an ancillary lid to said open mouth; and, wherein said sidewall structure and said base define a cavity as an interior of said container;

a translucent, cylindrical dome, comprising:

a dome base having a planar bottom surface and a convex top surface;

at least one dome detent formed into a surface of said planar member;

a drink compartment, having a circular sector cross section configuration and an open bottom, disposed on said top surface;

a plurality of storage compartments, each having a circular sector cross section configuration, disposed on said top surface;

wherein each storage compartments and said drink compartment are arranged to adjoin each other but are separated by a partition; and, wherein each partition is provided with a partition groove about a perimeter edge thereof;

a partition seal ring fitted into each partition groove;

a channel disposed at a central location of said bottom surface of said dome;

a plurality of fill tubes, each having a tubular shape, extending from a top of each storage compartment;

a mouth aperture extending from a top of said drink compartment;

at least one storage cap to cover and protect a fill tube, wherein each storage cap is provided with raised annular storage cap seal grooves to enable securement of said storage cap to a top of said fill tube via an interference fit;

a first fastening mechanism to hingedly affix each storage cap to a top of each fill tube;

a drink cap to cover and protect said mouth aperture, wherein said drink cap is provided with raised annular drink cap seal grooves to enable securement of said drink cap to a top of said mouth aperture via an interference fit;

a second fastening mechanism to hingedly affix said drink cap to a top of said mouth aperture;

a circular platform, comprising:

a disk member having a flat top surface;

at least one platform detent formed into a surface of said disk member;

a platform aperture located at a position to align with either one of said storage compartments or said drink compartment when said dome is placed over top of said platform;

a pivot aperture located at a position to align and engage said channel when said dome is placed over top of said platform;

a pivot pin, wherein:

said pivot pin slidably inserts between said engagement of said channel and said pivot aperture when said dome is placed over top of said platform; and, arrangement of said pivot pin, said pivot aperture, and said channel enables rotation of said dome relative to said platform while securing said dome to said platform;

a spring washer disposed about said pivot pin and situated between said dome and said platform, wherein said spring washer places tension on said dome and said platform to provide better securement of said dome with said platform and facilitate better rotational motion of said dome relative to said platform;

an apron, comprising:

an annular member extending perpendicularly from said platform; and, an apron groove within an inside surface of said annular member;

a third fastening mechanism to removably secure said apron to said open mouth of said container;

an apron seal placed within said apron groove, wherein said apron groove is configured to receive and retain said apron seal via an interference fit;

wherein said dome, when engaged with said platform, is placed on top of said container such that said apron extends over perimeter edges of said container and said apron seal forms a fluid tight abutment between said apron and said container;

wherein rotation of said dome relative to said platform enables selective alignment of said platform aperture with one of said storage compartments, thereby facilitating fluid communication between an interior space of said storage compartment and said cavity of said container;

wherein rotation of said dome relative to said platform enables selective alignment of said platform aperture with said drink compartment, thereby facilitating fluid communication between an interior space of said drink compartment and said cavity of said container; and, wherein at least one of said platform detent and at least one of said dome detent engage a portion of said dome as said dome is rotated to hold said dome in a desired potion.

* * * * *